US005500034A

United States Patent [19]

Martin

[11] Patent Number: 5,500,034

[45] Date of Patent: Mar. 19, 1996

[54] METHOD FOR PREHEATING A REACTOR FEED

[76] Inventor: Charles A. Martin, 10310 S. Braden Ave., Tulsa, Tulsa County, Okla. 74101

[21] Appl. No.: 435,674

[22] Filed: May 5, 1995

Related U.S. Application Data

[62] Division of Ser. No. 109,585, Aug. 20, 1993.

[51] Int. Cl.[6] ..... C21B 13/00

[52] U.S. Cl. ..... 75/505; 75/444; 423/439

[58] Field of Search ..... 75/505, 444; 423/439

[56] References Cited

U.S. PATENT DOCUMENTS

| | | | |
|---|---|---|---|
| Re. 32,247 | 9/1986 | Stephens, Jr. | 75/11 |
| 3,964,898 | 6/1976 | Murray | 75/505 |
| 4,053,301 | 10/1977 | Stephens, Jr. | 75/11 |
| 4,134,907 | 1/1979 | Stephens, Jr. | 260/449.6 |
| 4,147,334 | 4/1979 | Lafont et al. | 266/141 |
| 4,200,455 | 4/1980 | Bradbury et al. | 75/91 |
| 4,257,781 | 3/1981 | Stephens, Jr. | 48/197 R |
| 4,372,755 | 2/1983 | Tolman et al. | 48/197 R |
| 5,073,194 | 12/1991 | Stephens, Jr. et al. | 75/376 |
| 5,118,479 | 6/1992 | Stephens, Jr. et al. | 423/148 |
| 5,137,566 | 8/1992 | Stephens, Jr. et al. | 75/507 |
| 5,192,486 | 3/1993 | Whipp | 266/172 |

*Primary Examiner*—Melvyn Andrews
*Attorney, Agent, or Firm*—Baker & Botts

[57] ABSTRACT

A method and apparatus for preheating a reactor feed, comprised of an iron ore (10) and a process gas (21), in an iron carbide process for making steel is provided. The apparatus comprises a process gas preheater (40) having a furnace (56) and a heat exchanger (58). The process gas (21) is heated uniformly in tubes (117) of furnace (56) by burners (100). Excess heat generated by furnace (56) is captured by heat exchanger (58) and used to preheat combustion air (61) and ore (10).

20 Claims, 6 Drawing Sheets

FIG. 4
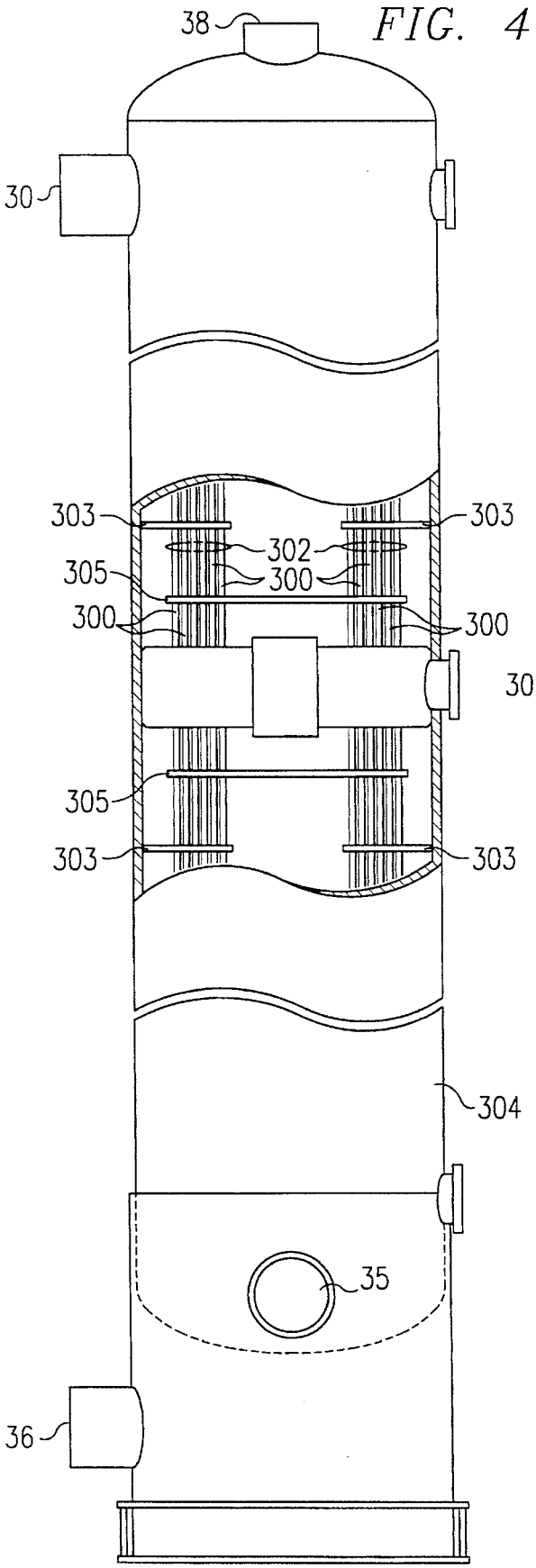
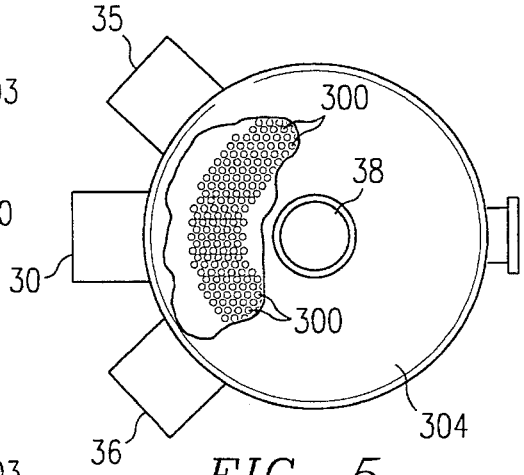
FIG. 5

METHOD FOR PREHEATING A REACTOR FEED

CROSS REFERENCE TO RELATED APPLICATIONS

This application is a divisional application of U.S. application Ser. No. 08/109,585, filed Aug. 20, 1993 and entitled "Method and Apparatus for Preheating a Reactor Feed," now pending.

TECHNICAL FIELD OF THE INVENTION

The present invention relates generally to the field of steel making. More particularly, the present invention relates to a method and apparatus for preheating a reactor feed in a process for the direct production of steel from particulate iron oxide.

BACKGROUND OF THE INVENTION

Recent innovations in steel making have been directed at making the process more efficient and less burdensome on the environment. One approach has been directed at eliminating the use of the blast furnace. In a conventional steel making process, iron ore is converted to steel in a blast furnace. By first converting the iron ore, which is primarily iron oxide, to iron carbide, the need for using a blast furnace can he avoided. A description of one process for the direct manufacture of steel from iron ore is described in U.S. Pat. No. Re. 32,247. The first step in such a process, called an iron carbide process, is to convert the ore (iron oxide) to iron carbide. In the iron carbide process, the iron oxides are converted to iron carbide in a fluidized bed at low temperatures with a mixture of reducing and carburizing gases such as hydrogen.

An important feature of the iron carbide process involves preheating the reactor feed, comprised of particulate iron oxide and a process gas such as hydrogen, prior to being treated in the fluidized bed reactor. One approach for preheating the reactor feed is described in U.S. Pat. No. 5,137,566. The furnaces previously used for preheating the reactor feed in the processes described in the foregoing patents suffered from the disadvantages of not providing for uniform heating of the tubes or coils transporting the process gas and of not capturing excess heat generated by the furnace. Another disadvantage of prior systems related to inadequate cooling of the flue gas. These and other disadvantages have been overcome by the method and apparatus of the present invention.

SUMMARY OF THE INVENTION

The method and apparatus of the present invention provides for the uniform heating of the gas line tubes conveying a process gas through a furnace and captures excess heat generated in the furnace for re-use thus cooling the flue gas to improve overall thermal efficiency.

In one embodiment of the present invention, an apparatus for preheating a reactor feed is provided. The apparatus comprises a gas line for conveying a process gas through a furnace. The gas line has an inlet opening for receiving a cool process gas and an outlet opening for discharging the heated process gas. Manifolds are connected to the gas line at the inlet and outlet openings for distributing the cool process gas through a plurality of tubes in the furnace and for collecting the heated process gas for discharge to a reactor. A plurality of burners for heating the process gas are positioned adjacent to both sides of the gas line tubes so that each of the tubes is heated uniformly. A heat exchanger is also provided to capture the excess heat and cool the flue gas.

In another embodiment of the present invention, a method is provided for preheating the reactor feed. The method comprises conveying a cool process gas in a gas line to an inlet opening of a furnace. In the next step, the cool process gas is distributed in a plurality of tubes within the furnace. The next step then requires heating the cool process gas, uniformly in the tubes of the gas line, to a pre-determined temperature. In the next step, the heated process gas is collected for discharge to a reactor. In the final step, excess heat is recovered from the furnace to cool the flue gas.

One technical advantage of the present invention is that a method and apparatus for preheating a reactor feed is provided that overcomes the disadvantages of prior systems by uniformly heating the tubes conveying the process gas through a furnace. Another technical advantage of the present invention is that excess heat generated in the furnace is captured. Still another technical advantage of the present invention is that the flue gas is cooled to improve the overall thermal efficiency of the system.

BRIEF DESCRIPTION OF THE DRAWINGS

For a more complete understanding of the present invention and the objects and advantages thereof, reference is now made to the following description taken in connection with the accompanying drawings in which like numbers identify like parts and in which:

FIG. 4 is a recycle gas exchanger for use in connection with the present invention;

FIG. 5 is an end view of the recycle gas exchanger of FIG. 5;

DETAILED DESCRIPTION OF THE INVENTION

Figure 1:
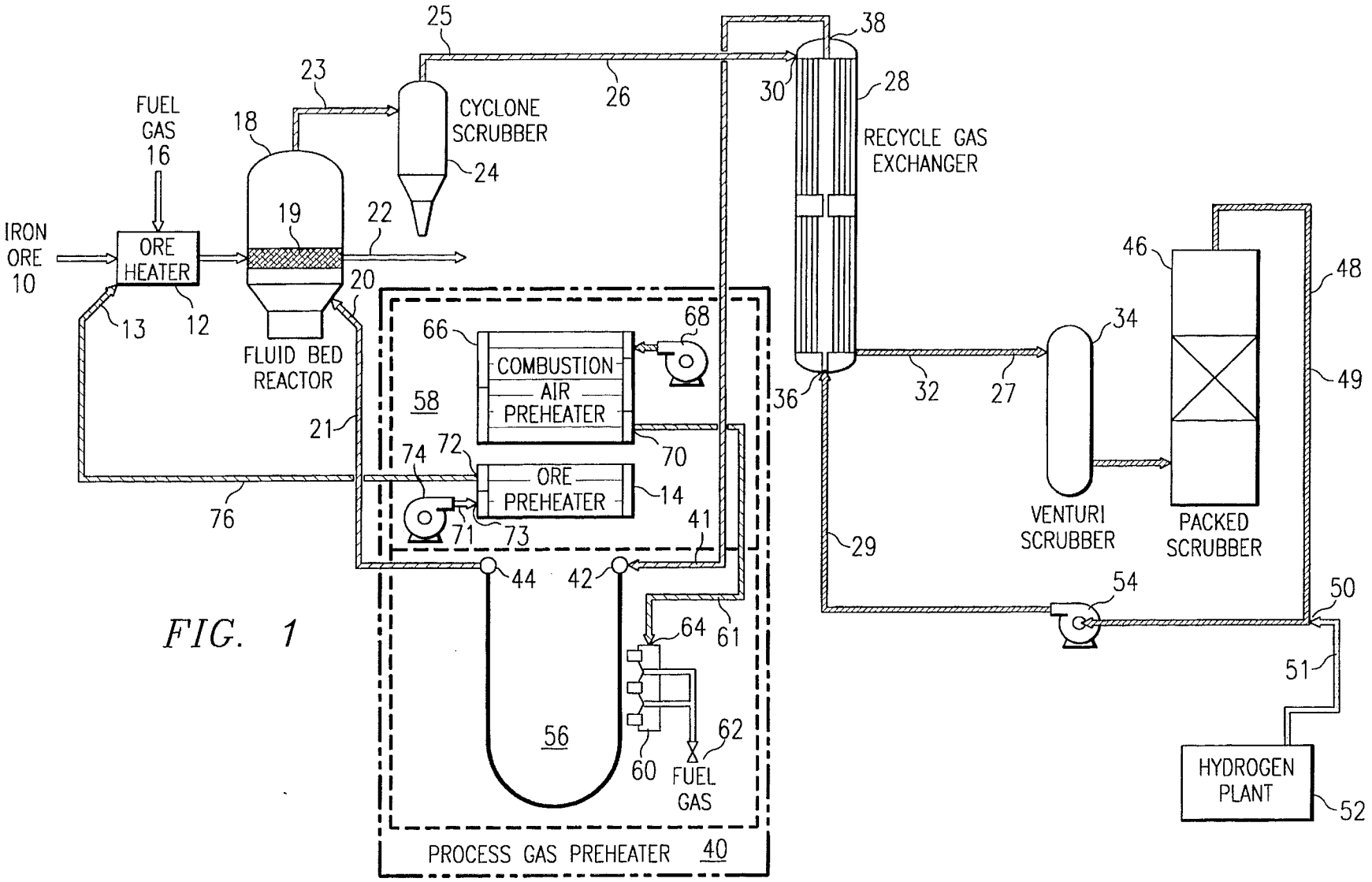
FIG. 1 is a block diagram illustrating the apparatus of the present invention and the system employing its use.

Referring now to FIG. 1, the present invention will be described in the context of an iron oxide to iron carbide conversion system for the steel industry.

Iron ore 10, suitably crushed to form particulate iron oxide, is fed to ore heater 12. Prior to entering ore heater 12, iron carbide ore 10 is preheated by exposing the ore to an airstream 13 heated with the excess heat captured by ore preheater 14. By preheating iron ore 10 using the captured excess heat captured by ore preheater 14, fuel gas 16 supplied to ore heater 12 can be significantly reduced.

The heated ore is then fed to fluid bed reactor 18 where the heated ore is combined with process gas 21 delivered on reactor feed line 20 in fluid bed 19. The iron carbide is discharged from fluid bed reactor 18 along conveyor 22 for further processing in the steel making process. The details of the processing of iron carbide into steel are well known to those skilled in the art and are described in U.S. Pat. No. Re. 32,247.

Exhaust dirty gas 23 from fluid bed reactor 18 is conveyed to cyclone scrubber 24 where particulate matter is removed from the stream of dirty gas 23. The scrubbed dirty gas 25 is transported from cyclone scrubber 24 along dirty gas inlet line 26 to recycle gas exchanger 28. Recycle gas exchanger 28 is an gas-to-gas heat exchanger that removes the heat from scrubbed dirty gas 25 entering exchanger 28 at inlet 30. After heat is removed from scrubbed dirty gas 25, cooled dirty gas 27 is discharged at outlet line 32. The cooled dirty gas 27 is then conveyed to venturi scrubber 34. The heat captured from dirty gas 23 is used to heat the process gas as will be explained later. While in the preferred embodiment, recycle gas exchanger 28 is shown as an gas-to-gas heat exchanger, other heat exchangers, such as a plate-to-plate heat exchanger, could be used as an alternative.

Clean process gas 29 enters recycle gas exchanger 28 at inlet 36 where heat is absorbed from the dirty gases 27 and exits exchanger 28 at clean gas outlet 38. Clean process gas 41 is then delivered to process gas preheater 40 at gas line inlet 42 of furnace 56. The process gas is then heated to the predetermined reaction temperature in furnace 56 of process gas preheater 40 before exiting at outlet 44. The heated process gas 21 is then conveyed along line 20 to fluid bed reactor After the dirty gas is first scrubbed in venturi scrubber 34 and then next cleaned in packed scrubber 46, it is mixed with fresh process gas 51 injected into line 48 at injector 50. Fresh process gas 51 is originally generated in hydrogen plant 52 and, with clean recycled process gas 49 flowing out of packed scrubber 46, is injected into recycle gas exchanger 28 using compressor 54. The cool clean process gas 29, that includes fresh process 51 gas generated in plant 52 and clean recycled process gas 49, is preheated in recycled gas exchanger 28 before injection into gas process preheater 40.

Process gas preheater 40 comprises furnace 56 and heat exchanger 58. Process gas 41 is heated in furnace 56 by burners 60 which combine fuel gas 62, such as natural gas, with preheated combustion air 61. While fuel gas 16 and 62 are natural gas in the preferred embodiment, other fuels known to those skilled in the art could be used as alternatives. Preheated combustion air 61 enters burner 60 at inlet port 64. Heat exchanger 58 comprises combustion air preheater 66 and ore preheater 14. Fresh air 67 is injected into combustion air preheater 66 using combustion fan 68 and exits the preheater 66 at outlet 70 and is injected into burner 60 at inlet port 64. Fresh air 71 enters ore preheater 14 at opening 73 using fan 74 and, after being discharged through outlet 72, is conveyed to ore heater 12 along line 76.

Figure 2:
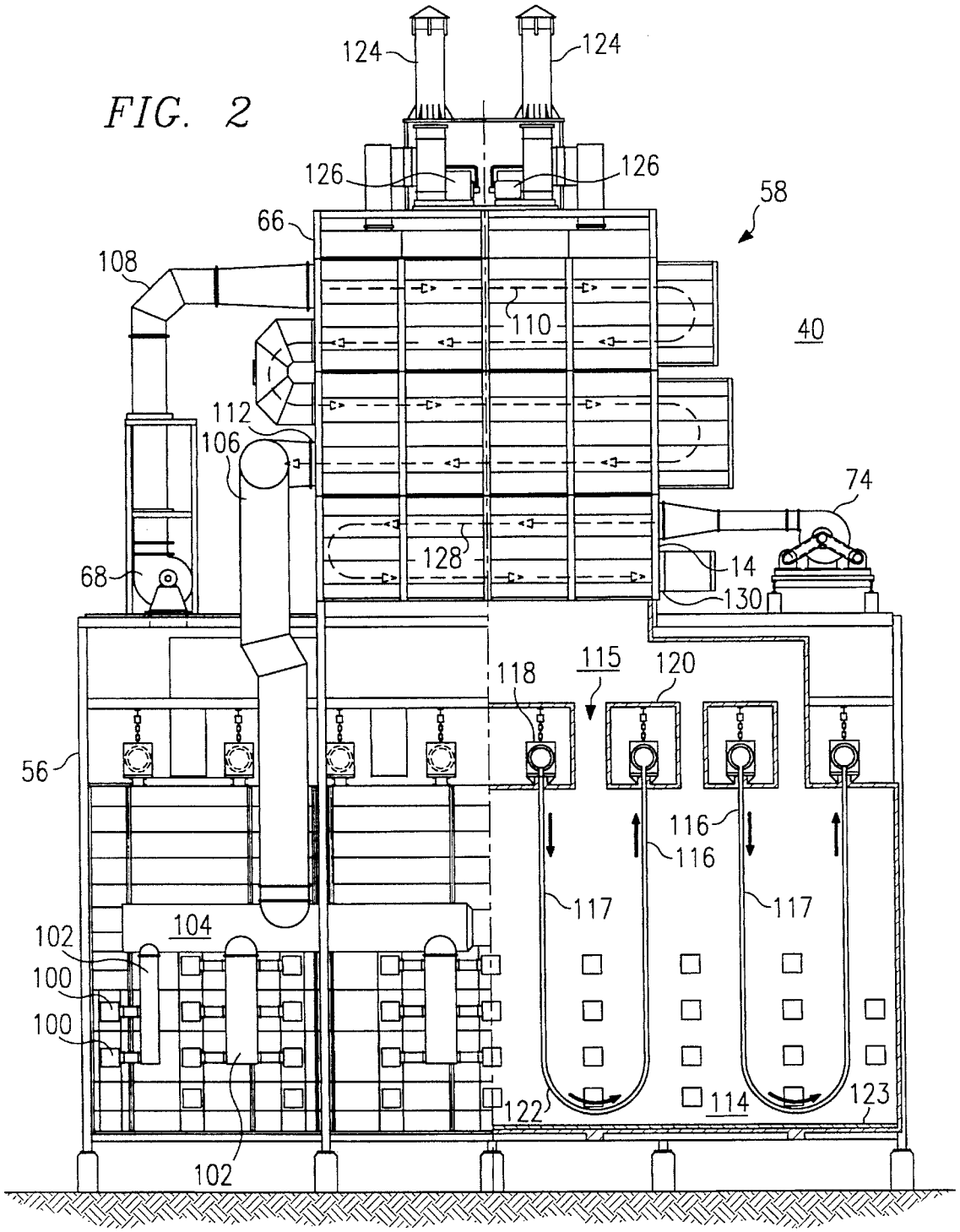
FIG. 2 shows a process gas preheater for use in connection with the present invention.

Referring now to FIG. 2, the process gas preheater of FIG. 1 will be described in more detail. Process gas preheater 40 includes furnace 56 and heat exchanger 58. In the preferred embodiment, furnace 56 includes a plurality of burners 100 which are shown schematically as burners 60 of FIG. 1. Each of burners 100 is connected to a distribution manifold 102 which in turn is connected to primary manifold 104. The fuel is supplied to each burner 100 along a fuel line not shown. Primary manifold 104 is connected to combustion air duct 106. Fresh combustion air is fed into heat exchanger 58 by combustion air fan 68 through conduit, 108. Upon entering heat exchanger 58, the combustion air is distributed in coils and flows along path 110. The preheated combustion air exits heat exchanger 58 at outlet port 112 for distribution to burners 100 via combustion air duct 106 and manifolds 104 and 102.

Inside furnace 56, shown by partial section of FIG. 2 at 114, a gas line 115 is comprised of inlet 42 (FIG. 1), manifold 118, coil assembly 116, manifold 120 and outlet 44 (FIG. 1). In partial section 114, two process coil assemblies 116 are shown. Each of process coil assemblies 116 is comprised of a plurality of tubes 117 connected to manifolds 118 and 120. Manifold 118 is connected to the process gas inlet 42 (shown in FIG. 1) and distributes the process gas through the tubes of process coil assembly 116. Each tube of process coil 116 has an elbow 122. The process gas flows in tubes 117 of process coil assembly 116, as shown by the arrows, and passes through manifold 118 around elbow 122 and is collected by manifold 120 for discharge through outlet opening 44 (shown in FIG. 1). The burners 100 are configured along the ends and adjacent to both sides of tubes 117 of process coil assembly 116 so that each of tubes 117 is exposed to heating on all sides. By providing burners 100 adjacent to both sides of each tube 117 of coil 116, the tubes are heated uniformly so that thermal expansion is uniform and does not cause undue stresses or strains on the coil assemblies 116 and furnace 56. While in the preferred embodiment process coil assemblies 116 are shown attached to manifolds 118 and 120 so that tubes 117 hang down, it is also possible to locate manifolds 118 and 120 adjacent to floor 123 so that tubes 117 project up. An alternative embodiment would be to use straight tubes and expansion joints.

As a result of the combustion of air and fuel in burners 100, a flue gas is generated that is exhausted through one or more stacks 124. Each of stacks 124 is connected to an induced draft fan 126 to draw the flue gas through heat exchanger 58. While the preferred embodiment is shown as a push-pull system, alternatively either a push system with a larger combustion air fan 68 or a pull system with larger induced draft fans 126 could be used. As the flue gas passes through heat exchanger 58, excess heat is drawn off and reprocessed through the system. Beneath combustion air preheater 66, is positioned ore preheater 14. Fresh air enters ore preheater, using fan 74, and follows path 128 to outlet 130 for transport along line 76 to ore heater 12 of FIG. 1. While in the preferred embodiment combustion air preheater 66 is shown located above ore preheater 14, alternatively ore preheater 14 could be above combustion air preheater 66 or the two preheaters could be placed in parallel with one another.

Figure 3:
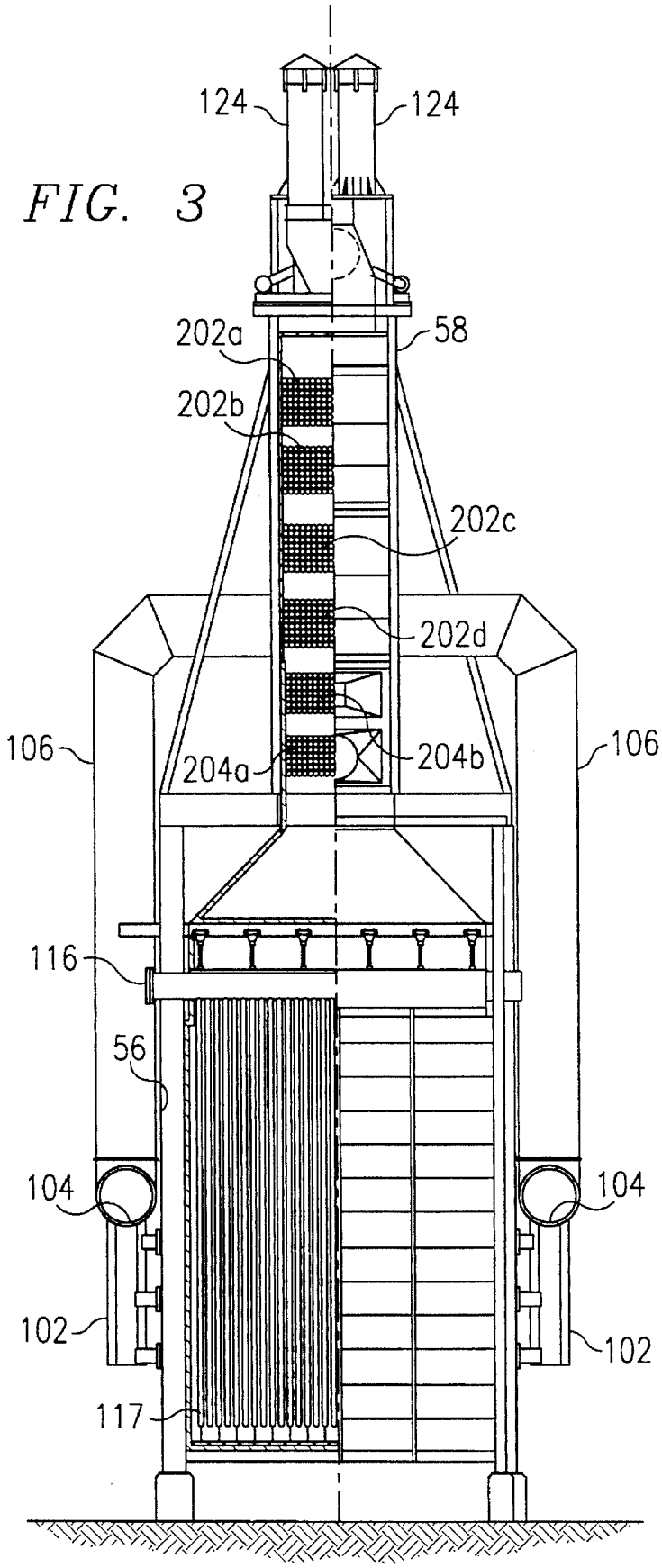
FIG. 3 is a cross sectional view of the process gas preheater of FIG. 2.

Referring now to FIG. 3, a cross-section of process gas preheater 40 is described. Tubes 117 of process coil assembly 116 are shown in partial section of furnace 56. Burners 100 are shown connected to distribution manifold 102 and primary manifold 104. Combustion air duct 106 is shown connected to both sides of furnace 56. Heat transfer coils **202*a*, 202*b*, 202*c* and 202*d* are positioned in heat exchanger 58 so that the heated flue gas passes over them extracting excess heat from process gas preheater 40. The flue gas also contacts coils 204*a* and 204*b* of ore preheater 14. Each of the coils 202*a*, 202*b*, 202*c*, 202*d*, 204*a* and 204*b* is connected using a flexible hose or conduit (not shown) to allow for thermal expansion. After the flue gas passes through coils 204*a*, 204*b*, 202*a*, 202*b*, 202*c* and 202*d*, the temperature of the flue gas exiting process gas preheater 40 at stacks 124 is cooled. While in the preferred embodiment heat exchanger 58 is used to preheat the iron ore and the combustion air, alternatively heat exchanger 58** could also be used to generate steam that can be employed in other process steps or to drive a turbine for electric power generation.

Referring now to FIGS. 4 and 5 a recycle gas heat exchanger for use in connection with the method and apparatus of the present invention is described. Recycle gas exchanger 28 of FIG. 1 is shown in FIGS. 4 and 5 in partial section view. Recycle gas exchanger 28 comprises clean gas inlet 36 for receiving fresh process gas. The fresh process gas is distributed by a manifold (not shown) into tubes 300 of tube bundle 302. The fresh process gas exits recycle gas exchanger 28 at clean gas outlet 38. As the clean gas passes through tubes 300 in recycle gas exchanger 28, it absorbs heat from dirty gas exiting reactor 18 that is received at dirty gas inlet 30. The dirty gas passes through recycle gas exchanger 28 and exits the exchanger at dirty gas outlet 35. Baffles 303 and 305 are provided to aid in heat transfer and flow distribution. Tubes 300 of tube bundle 302 are enclosed in shell 304.

Figure 6:
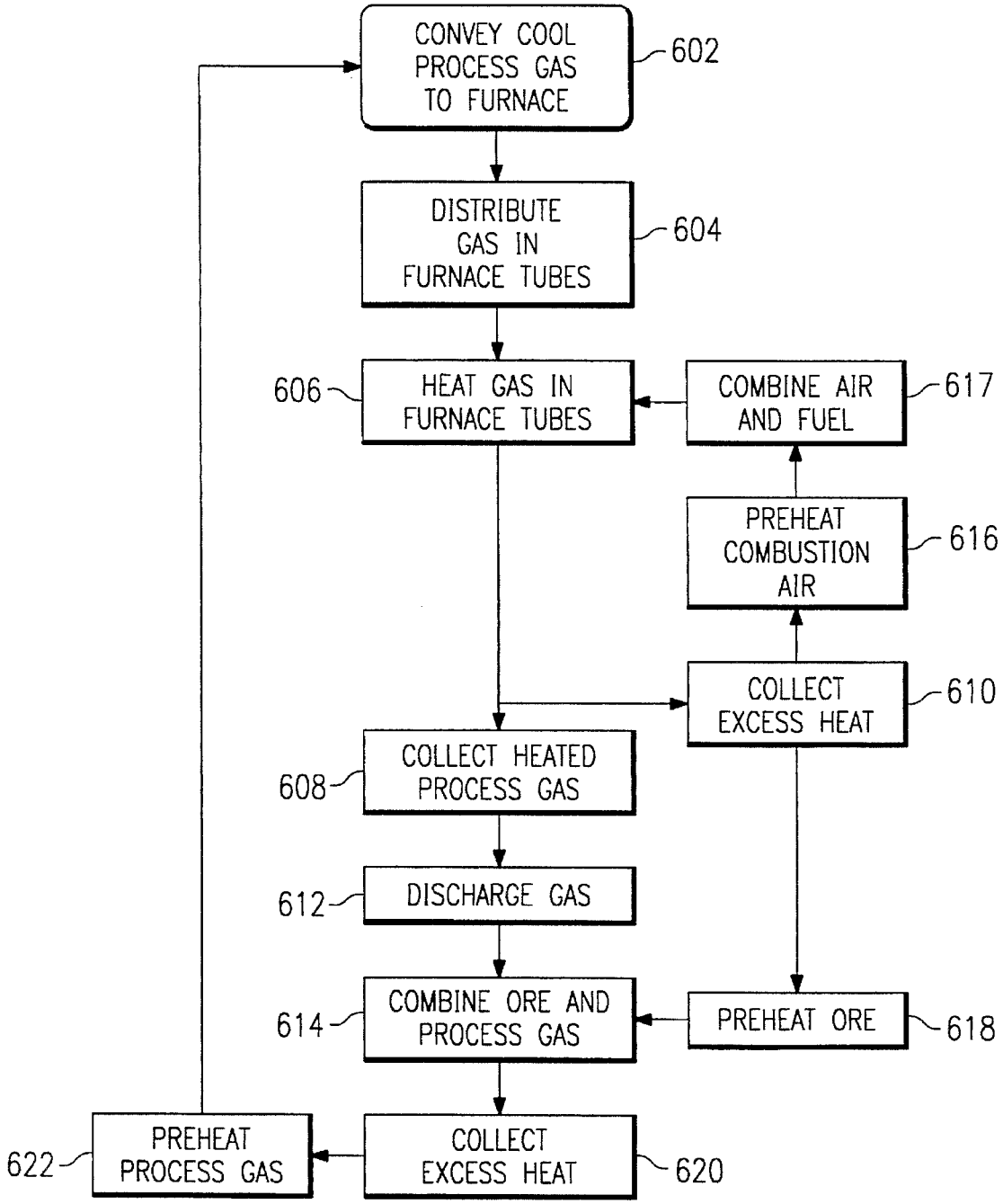
FIG. 6 is a flow chart diagram describing the steps of the method of the present invention.

Referring now to FIG. 6, a flow chart describing the steps of the method of the present invention are shown. In step 602, cool process gas is conveyed to a furnace. As will be shown subsequently, the cool process gas may have actually been preheated but will enter the furnace at a temperature below the predetermined reaction temperature. In the next step 604, the cool process gas is distributed in furnace tubes for broader distribution in a furnace. In the next step 606, the process gas in the furnace tubes is heated to the predetermined temperature. In the next step 608, the heated process gas is collected for discharge out of the furnace. In step 610, excess heat generated in the furnace is collected. The collected process gas of step 608 is discharged from the system in step 612. In step 614, the heated process gas is combined with iron oxide or iron ore in a reactor to produce iron carbide. In step 616, the excess heat collected in step 610 is used to preheat combustion air that is combined with fuel in step 617 for generating heat to feed back into the furnace at step 606. At the same time, additional heat collected in step 610 is used in step 618 to preheat the iron ore prior to delivery to the reactor in step 614. In step 620, excess heat generated by the reactor during step 614 is collected. The excess heat collected in step 620 is conveyed to a heat exchanger and in step 622 the excess heat is used to preheat the process gas prior to being conveyed to the furnace in step 602.

Figure 7:
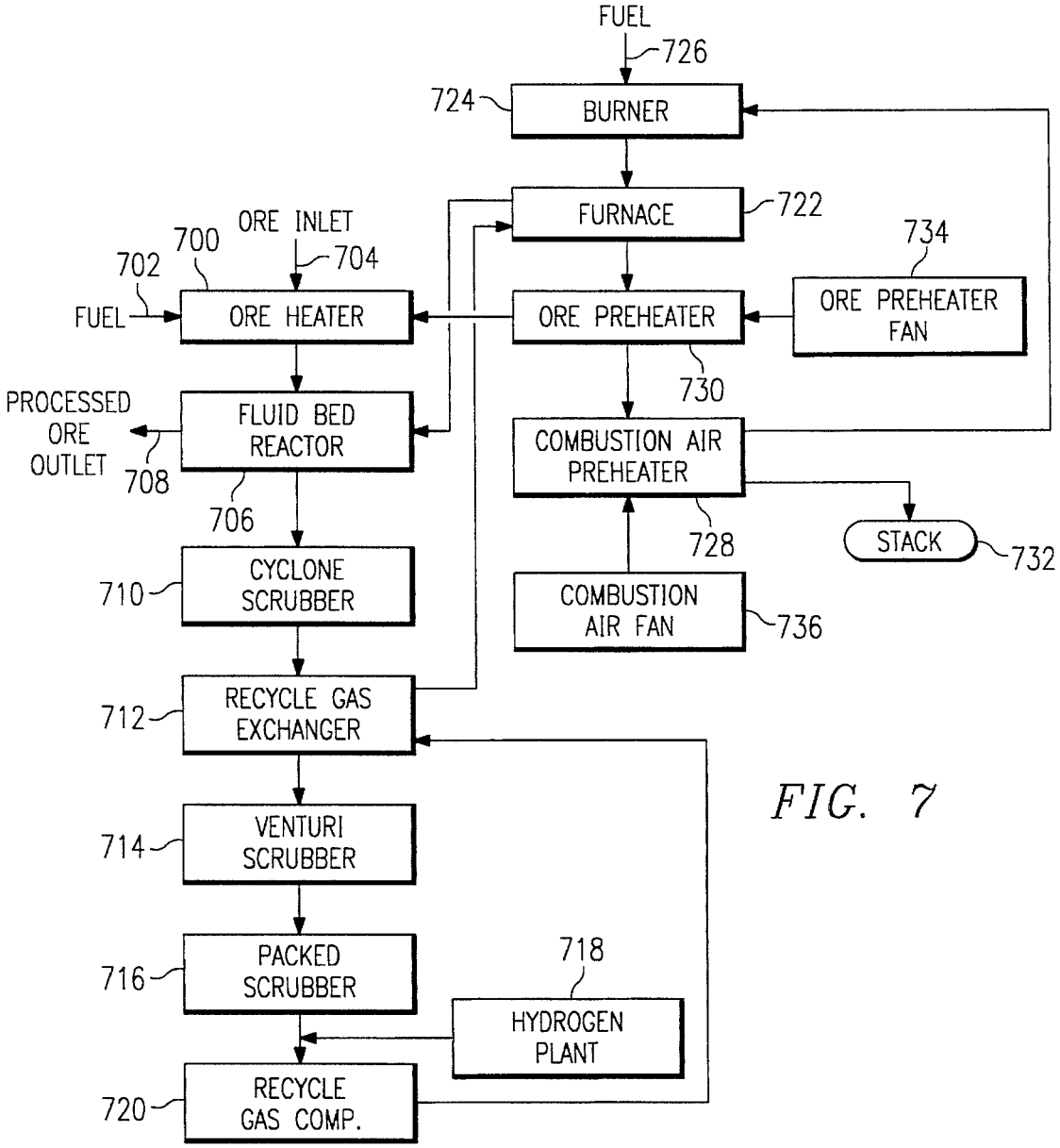
FIG. 7 is a flow diagram describing the method and apparatus illustrated in FIG. 1.

Referring now to FIG. 7, the method and apparatus of the present invention will be described in connection with the system described in FIG. 1. Ore heater 700 receives fuel 702 and iron ore via inlet 704. The heated ore is then conveyed to fluid bed reactor 706 where the iron oxide is converted to iron carbide and the processed ore is discharged at process ore outlet 708. Exhaust gas from fluid bed reactor 706 is discharged to cyclone scrubber 710 where particulate matter is removed prior to the exhaust gas being received at recycled gas exchanger 712.

The dirty gas flows through recycle gas exchanger 712 and is transported to venturi scrubber 714 where it is further cleaned before passing to packed scrubber 716 for final removal of particulate matter from the dirty gas air stream. The clean gas is then combined with fresh hydrogen from hydrogen plant 718 and, through recycle gas compressor 720, is fed to the recycle gas exchanger for preheating. The preheated process gas flows through recycle gas exchanger 712 to furnace 722 where it is heated to the suitable processing temperature before delivery to fluid bed reactor 706. The process gas flowing through furnace 722 is heated by burner 724 which combines fuel 726 and preheated combustion air delivered from combustion air preheater 728. The hot flue gas leaving furnace 722 is exposed to ore preheater 730 and combustion air preheater 728 to remove excess heat before passing into the atmosphere through stack 732. Ore preheater fan 734 and combustion air fan 736 are used to force air through ore preheater 730 and combustion air preheater 728.

While the present invention has been described with reference to the presently preferred embodiments, it will be appreciated that the invention may be embodied in other specific forms without departing from its spirit or central characteristics. Accordingly, the described embodiment is to be considered in all respects only as illustrative and not restrictive. The scope of the invention is, therefore, indicated by the appended claims rather than by the foregoing description. All modifications or changes which come within the meaning and range of equivalency of the claims are to be embraced within their scope.

What is claimed is:

1. A method for preheating a reactor feed, comprising:

conveying a cool process gas to an inlet of a furnace;

providing a plurality of tubes from the inlet of the furnace to an outlet of the furnace, each of the tubes forming an elbow between the inlet and the outlet;

distributing the cool process gas in the tubes within the furnace;

heating the cool process gas, uniformly in the tubes, to produce a heated process gas;

collecting the heated process gas for discharge from the furnace; and conveying the heated process gas to a reactor.

2. The method of claim 1 further comprising the step of cooling a flue gas produced by the step of heating.

3. The method of claim 1 wherein the process gas is hydrogen.

4. The method of claim 1 further comprising the step of recovering excess heat produced by the step of heating.

5. The method of claim 4 further comprising the step of conveying the excess heat to an ore heater.

6. The method of claim 4 further comprising the step of using the excess heat to preheat combustion air supplied to a burner in the furnace.

7. The method of claim 1 wherein the heated process gas is conveyed to an iron carbide reactor.

8. The method of claim 1 further comprising the step of combining iron oxide and the heated process gas to form iron carbide.

9. A method for heating a process gas, comprising:

conveying a cool process gas to a furnace having an inlet and an outlet;

providing a plurality of tubes with an elbow disposed between the inlet and the outlet;

distributing the cool process gas in the tubes;

heating the cool process gas, in the tubes, to produce a heated process gas; and collecting the heated process gas at the outlet.

10. The method of claim 9, comprising the step of conveying the heated process gas to a reactor.

11. The method of claim 9, comprising the step of cooling a flue gas produced by the step of heating.

12. The method of claim 9, comprising the step of recovering excess heat produced by the step of heating.

13. The method of claim 12, comprising the step of conveying the excess heat to an ore heater.

14. The method of claim 12, comprising the step of using the excess heat to preheat combustion air supplied to a burner in the furnace.

15. The method of claim 9, comprising the step of combining iron oxide and the heated process gas to form iron carbide.

16. A method for preheating a reactor feed, comprising:

conveying a cool process gas to a furnace having an inlet and an outlet;

distributing the cool process gas in a plurality of elbowed tubes disposed between the inlet and the outlet;

heating the cool process gas, in the elbowed tubes, to produce a heated gas collecting the heated process gas at the outlet; and conveying the heated process gas to a reactor.

17. The method of claim 16, comprising the step of recovering excess heat produced by the step of heating.

18. The method of claim 17, comprising the step of conveying the excess heat to an ore heater.

19. The method of claim 17, comprising the step of using the excess heat to preheat combustion air supplied to a burner in the furnace.

20. The method of claim 16, comprising the step of combining iron oxide and the heated process gas to form iron carbide.

* * * * *